United States Patent [19]

Hill

[11] Patent Number: 4,622,861

[45] Date of Patent: Nov. 18, 1986

[54] ACTUATOR MECHANISM

[75] Inventor: Stephen Hill, Nevada City, Calif.

[73] Assignee: The Grass Valley Group, Inc., Grass Valley, Calif.

[21] Appl. No.: 728,067

[22] Filed: Apr. 29, 1985

[51] Int. Cl.[4] ..... G05G 5/16

[52] U.S. Cl. ..... 74/531; 74/10 R

[58] Field of Search ..... 74/10 R, 531

[56] References Cited

U.S. PATENT DOCUMENTS

| | | | |
|---|---|---|---|
| 2,560,015 | 7/1951 | Waldron | 74/531 |
| 2,587,875 | 3/1952 | Moore et al. | 74/531 X |
| 2,857,783 | 10/1958 | Ranck, Jr. et al. | 74/531 |
| 3,082,640 | 3/1963 | Blomberg | 74/531 |
| 3,319,484 | 5/1967 | Prest | 74/531 |
| 4,018,104 | 4/1977 | Bland et al. | 74/531 |

*Primary Examiner*—Allan D. Herrmann

*Attorney, Agent, or Firm*—John Smith-Hill; Francis I. Gray

[57] ABSTRACT

An actuator mechanism, particularly for a potentiometer, comprises a mounting frame defining an interior space. An elongate rotary shaft traverses that space. A lever arm is secured to the shaft and extends radially away from the longitudinal axis of the shaft within the space defined by the mounting frame. The mounting frame has two substantially parallel surfaces that confront the lever arm, and respective friction assemblies are interposed between the lever arm and those two surfaces respectively. Each friction assembly comprises a body of friction material engaging one of the two parallel surfaces, and a compression spring that urges the body of friction material against that surface. The body of friction material and the spring are maintained captive between the lever arm and the surface of the frame that is engaged by the body of friction material.

4 Claims, 2 Drawing Figures

ACTUATOR MECHANISM

This invention relates to an actuator mechanism, and more particularly, but not exclusively, to a control lever arm for driving a potentiometer.

BACKGROUND OF THE INVENTION

A video production switcher includes means for switching between two or more input video signals in order to generate an output video signal. In the case of an abrupt change from one input video signal to another, a simple switch can be used to effectuate the change, but in the case of a slower transition, such as a wipe or a fade, a rotary potentiometer is used to generate a control signal that causes the change to take place over a perceptible time, for example, 0.5 s. In such a case, in order to avoid jerkiness in the transition, and assuming that the potentiometer has a linear angular position to electrical resistance relationship, it is necessary that the shaft of the potentiometer be rotated so that its angular position changes smoothly.

It has been found that a lever arm is more favorable for use under these conditions than a simple rotary knob, because it is easier for the operator to maintain smoothness of motion when the motion is a linear motion of the lower arm than when it is a twisting of the wrist. Nevertheless, in order to maintain smoothness of the motion it is necessary to include a mechanical resistance element in the actuator mechanism so that the operator can, by tactile feedback, avoid jerkiness and irregularities in the movement of the lever arm. It has hitherto been conventional to use discs of synthetic friction material sandwiched between spring-loaded metal plates to provide this tactile feedback, but this is subject to several disadvantages, such as high cost of manufacture and assembly, and a large number of different parts.

An additional problem with use of a lever arm to drive a rotary potentiometer is that axial loading on the shaft of the potentiometer tends to damage the potentiometer and to cause irregularities in the resistance of the potentiometer, regardless of how smoothly the shaft is rotated.

SUMMARY OF THE INVENTION

In a preferred actuator mechanism embodying the invention, a mounting frame member defines an interior space and an elongate rotary shaft traverses that space. A rigid member, such as a lever arm, is secured to the shaft and extends radially away from the longitudinal axis of the shaft within the space defined by the mounting frame member. One of the aforesaid members has two substantially parallel surfaces that confront the other member, and the actuator mechanism further comprises first and second friction assemblies interposed between the member having the two substantially parallel surfaces and the other member. Each friction assembly comprises a body of friction material engaging one of the two parallel surfaces, and a compression spring that urges the body of friction material against that surface. The body of friction material and the spring are maintained captive between the aforesaid other member and the surface engaged by the body of friction material.

In the preferred embodiment of the invention, the frame comprises two metal plates and the rigid member is a lever arm. Two pairs of friction assemblies are carried by the lever arm, diametrically opposite each other with respect to the longitudinal axis of the rotary shaft, and are held in position by pins that extend through the lever arm, parallel to the rotary shaft.

DETAILED DESCRIPTION

Figure 1:
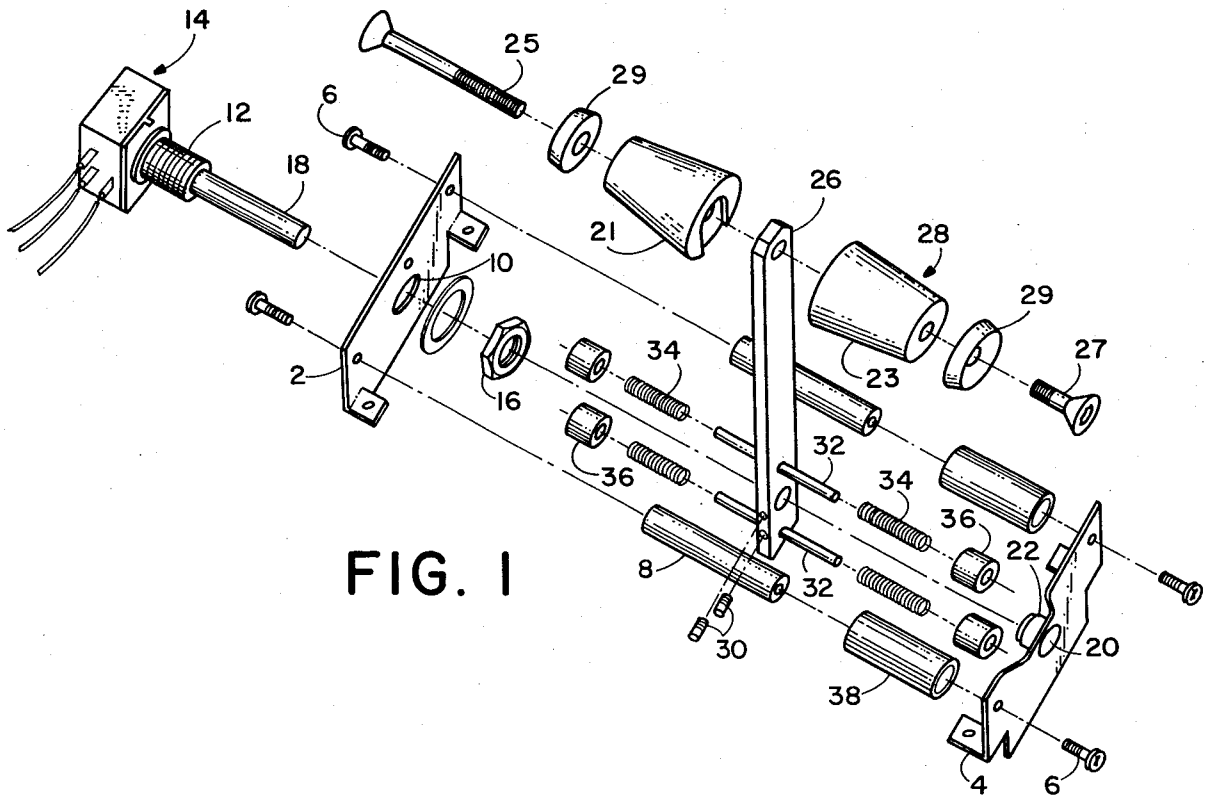
FIG. 1 is a perspective exploded view of a lever arm assembly embodying the present invention.
Figure 2:
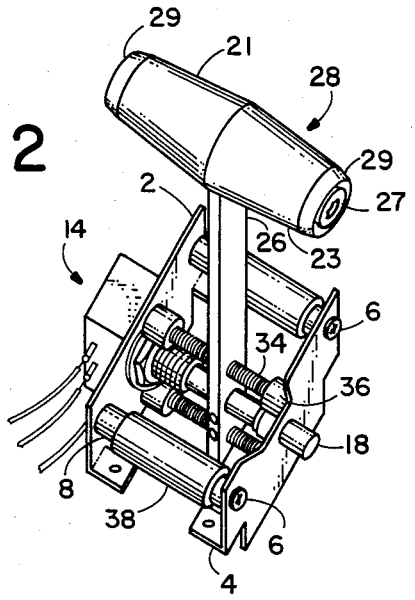
FIG. 2 is a perspective assembled view of the lever arm assembly of FIG. 1.

The lever arm assembly shown in FIGS. 1 and 2 comprises two brass support plates 2 and 4 which are secured together in spaced relationship by screws 6 that are threaded into spacers 8. The plate 2 is formed with an opening in which the threaded support bushing 12 of a potentiometer 14 is secured by means of a nut 16. The potentiometer is of the kind that requires only 90 degrees of rotation of the shaft in order to adjust the resistance value of the potentiometer through its full range. The shaft 18 of the potentiometer extends across the space defined between the plates 2 and 4, and its end is fitted in a sleeve 20. The sleeve 20 is made of low friction material, such as PTFE, (polytetrafluroethylene) and is held in position by means of a metal shell 22 that is crimped about the sleeve 20 and is itself secured to the plate 4 by being pressed into it.

A lever arm 26, having a handle 28, is secured to the shaft 18 by screws 30. Thus, pivoting movement of the arm 26 is accompanied by rotational movement of the shaft 18. The handle 28 has two parts 21, 23 which fit over the end of the arm 26 and are secured thereto by screws 25, 27, and bushings 29, screw 25 extending through part 21 and the arm into part 23. Diametrically opposite each other, with respect to the shaft 18, the lever arm 26 carries two rods 32. Each rod extends through the lever arm 26 and projects, at its opposite ends, towards the plates 2 and 4 respectively. Each end of each rod carries a friction assembly comprising a compression spring 34 and a tubular PTFE pad 36. The spring 34 fits loosely on the rod 32, but a close tolerance is maintained between the diameter of the rod 32 and the internal diameter of the pad 36 in order to eliminate lost motion. The rods 32 are each shorter than the distance between the plates 2 and 4, and the pad 36 is dimensioned so that it is held captive on the rod 32 between the lever arm 26 and the plate 2 or 4. The spring 34 is of a size to engage the lever arm 26 and urge the pad 36 against the plate 2 or 4.

The force of the springs 34 urging the pads against the plates 2 and 4 generates a significant frictional reaction to pivoting of the lever arm. The plates 2 and 4 are machined, on their confronting surfaces, to mill finish, and these confronting surfaces are provided with protective plastic covering layers that are not removed until assembly of the mechanism. The result is that the possibility of scratching or contamination of the surfaces is minimized, and accordingly when the lever arm is in use the pads 36 slide smoothly over the confronting surfaces of the plates 2 and 4.

The spacers 8 are positioned relative to the shaft of the potentiometer to allow the lever arm to pivot through 90 degrees about the axis of the shaft 18, and polyurethane tubes 38 are fitted around the spacers 8 to act as buffers, providing a soft feel when the lever arm reaches the end of its travel.

It will be noted that the design of the mounting frame and the friction assemblies is symmetrical about the lever arm 26. This keeps the number of unlike parts to a minimum, making for a low parts cost and for ease of assembly, resulting in low assembly cost. Moreover, the symmetry of the design eliminates axial loading on the potentiometer shaft 18.

It will be appreciated that the invention is not restricted to the particular potentiometer actuator mechanism that has been shown and described, and that variations may be made therein without departing from the scope of the invention as defined in the appended claims, and equivalents thereof. For example, the invention is not restricted to an actuator mechanism for a potentiometer, and could be applied to other devices having rotary shafts that need to be rotated, for example a shaft encoder. Although it is preferred that the compression springs and the pads be mounted on rods, they could instead be fitted inside tubes.

I claim:

1. An actuator mechanism, comprising a frame member defining an interior space, an elongate shaft that traverses said interior space and is mounted so as to be rotatable about its longitudinal axis with respect to the frame member, and a rigid member secured to the shaft and extending within said space radially away from the longitudinal axis of the shaft, one of said members having first and second substantially parallel surfaces that confront the other of said members, and the actuator mechanism further comprising first and second friction assemblies interposed between said other member and said first and second surfaces respectively, each friction assembly comprising a body of friction material engaging one of said surfaces, and a compression spring effective between said other member and the body of friction material for urging the body of friction material against the surface that it engages, the body of friction material and the spring being held captive between said other member and the surface engaged by the body of friction material.

2. A mechanism according to claim 1, wherein said rigid member is a lever arm having two collinear rod portions projecting from opposite sides thereof towards said first and second surfaces respectively, and wherein each body of friction material is tubular in form and is fitted on one of said rod portions, said compression springs being interposed between the bodies of friction material and the lever arm.

3. An actuator mechanism according to claim 1, wherein said frame member is said one member and said rigid member is said other member, and the rigid member has first and second collinear rod portions projecting from opposite sides thereof towards said first and second surfaces respectively, and said bodies of friction material are tubular in form and are fitted on said rod portions respectively, the compression springs also being fitted on said rod portions between said rigid member and said bodies of friction material.

4. An actuator mechanism according to claim 3, comprising two pairs of first and second friction assemblies disposed diametrically opposite each other with respect to the shaft.

* * * * *